United States Patent [19]

Verma

[11] Patent Number: 4,524,404

[45] Date of Patent: Jun. 18, 1985

[54] HIGH VOLTAGE INSULATOR ASSEMBLAGE HAVING SPECIALLY-CHOSEN SERIES RESISTANCE

[76] Inventor: Manoranjan P. Verma, Goethestrasse 5, D-6805 Heddesheim, Fed. Rep. of Germany

[21] Appl. No.: 384,603

[22] Filed: Jun. 3, 1982

[30] Foreign Application Priority Data

Jun. 26, 1981 [DE] Fed. Rep. of Germany ..... 3125203
Feb. 5, 1982 [EP] European Pat. Off. ..... 82100844.8

[51] Int. Cl.[3] ..... H01B 17/42

[52] U.S. Cl. ..... 361/132; 174/140 R; 174/140 S; 174/141 R

[58] Field of Search ..... 174/139, 140 R, 140 C, 174/140 H, 140 S, 140 CR, 141 R, 141 C, 142, 179, 211; 361/132

[56] References Cited

U.S. PATENT DOCUMENTS

| | | | |
|---|---|---|---|
| 1,449,694 | 3/1923 | Peek, Jr. | 361/132 X |
| 2,776,332 | 1/1957 | Von Cron | 174/140 R X |
| 4,267,403 | 5/1981 | Pargamin | 174/140 S |

FOREIGN PATENT DOCUMENTS

| | | | |
|---|---|---|---|
| 969089 | 4/1958 | Fed. Rep. of Germany | 174/140 C |
| 2006247 | 10/1971 | Fed. Rep. of Germany | 174/140 C |
| 2034463 | 1/1972 | Fed. Rep. of Germany | 174/140 R |
| 2361204 | 6/1975 | Fed. Rep. of Germany | 174/140 S |
| 528337 | 8/1921 | France | 174/140 R |
| 288561 | 5/1953 | Switzerland | 174/141 R |
| 527357 | 10/1940 | United Kingdom | 174/141 R |
| 869797 | 6/1961 | United Kingdom | 174/139 |
| 940400 | 10/1963 | United Kingdom | 174/139 |
| 1014624 | 12/1965 | United Kingdom | 174/140 S |
| 1039193 | 8/1966 | United Kingdom | 174/140 S |
| 1296038 | 11/1972 | United Kingdom | 174/179 |

OTHER PUBLICATIONS

Verma, M. P. et al., CIGRE Report 33-09, "The Criterion for Pollution Flashover and Its Application to Insulator Dimensioning and Control", International Conference on Large High Voltage Electric Systems, 1978 Session, Aug. 30 to Sep. 7, 1978, 12 pages.

Verma, M. P., "Mechanism of A.C. Flashover on Polluted Insulators", Feb. 26-27, 1981, 5 pages.

*Primary Examiner*—Laramie E. Askin

*Attorney, Agent, or Firm*—Schwartz, Jeffery, Schwaab, Mack, Blumenthal & Koch

[57] ABSTRACT

The invention relates to an outdoor high voltage insulator, wherein the flashover due to the effect of external layers or deposits of pollution is prevented or at least shifted in the direction of higher degree of pollution. A resistance element (1) is connected in series with the insulator itself (2), with the leakage current prior to flashover producing a voltage drop over the resistance element (1). This voltage drop reduces the voltage on the insulator and prevents or retards flashover.

16 Claims, 13 Drawing Figures

HIGH VOLTAGE INSULATOR ASSEMBLAGE HAVING SPECIALLY-CHOSEN SERIES RESISTANCE

BACKGROUND OF THE INVENTION

The present invention pertains to a high voltage resistor for outdoor insulating arrangements suitable for preventing pollution flashovers. The resistor is comprised of an insulator body and a resistance material which is connected in series with an insulator. In such arrangements, one or more high voltage resistors and high voltage insulators of any desired design, such as, for example, long rods, post insulators or cap-and-pin type insulators can be used, both for d.c. as well as for a.c. voltages.

The high voltage resistor is intended to prevent flashovers caused by conductive layers, particularly wetted pollution layers, on the surface of outdoor insulators. In the case of such conductive surfaces, initially a so-called pollution-leakage current flows. This current dries the layers at the locations of highest current densities, and so-called dry zones are formed. These dry zones are subsequently bridged over by partial arcs as the result of the non-uniform voltage distribution. If the conductivity of the zones which are still wet is excessive, the partial arcs elongate and flashover occurs at the line-to-ground voltage. Attempts are being made to prevent this flashover by increasing the leakage path with greater overall length for the same insulator profile, or by retaining the overall length and using insulators with a longer leakage distance. However, the use of these two measures is possible to a limited extent only, so that flashovers can still occur in the case of heavier pollution. In the case of very heavy pollution, these measures are not successful. It has therefore been attempted, as shown by British Pat. No. 1,039,193, to provide high voltage insulators with a conductive surface, in order to prevent the non-uniform voltage distribution, which is responsible for the formation of partial arcs. In particular, the semi-conductive glaze proposed therein is intended to prevent the necessary wetting by heating of the insulator. The disadvantage of this solution resides in the fact that high leakage current losses are constantly generated. Furthermore, layers of this type are difficult to produce with the necessary uniformity, thermal stability and aging resistance, especially for large insulators.

Another measure is found in British Pat. No. 1,296,038. In order to prevent surface pollution flashovers, a cylindrical resistor is arranged in series with the insulator. This resistor is dimensioned so that the leakage current flowing over the surface of the insulator remains small and does not exceed a certain value. The resistor required for this purpose must have resistance values within a range of several mega-ohms to one hundred mega-ohms. The disadvantage of this system is that, following the formation of a conductive layer on the insulator, nearly all of the line-to-ground voltage must be taken over by the resistor, since the value of the surface resistance in the case of heavy pollution is very much lower than that of the resistor connected in series. This makes the insulator arrangement very long. Furthermore, the arrangement becomes ineffective if a conductive layer is formed by pollution on the surface of the resistor connected in series, so that it is necessary to mount covers, for example, of a conical configuration to protect the construction from pollution, as shown by the embodiment illustrated in the British patent.

SUMMARY OF THE INVENTION

It is therefore an object of the present invention to provide a high voltage resistor for use in a series with a high voltage insulator for outdoor insulating arrangements, so that in spite of the presence of conductive surface layers, no flashover occurs and a low overall length is attained.

In accomplishing the foregoing objects, there has been provided according to the present invention a high voltage resistor comprised of an insulator body and a resistance material, connected in series with the high voltage insulator and the characteristic leakage current pulse for the high voltage insulator causes a voltage drop of at least 5% of the total live-to-ground voltage on the total resistance of the high voltage resistor, and its shape resembles the original insulator with sheds. In preferred embodiments, the external surface of the high voltage resistor is covered with a hydrophobic layer, and the insulator body is comprised of ceramic, glass or a synthetic resinous material.

Further objects, features and advantages of the present invention will become apparent from the detailed description of preferred embodiments which follows, when considered together with the attached figures of drawing.

DETAILED DESCRIPTION OF PREFERRED EMBODIMENTS

According to the present invention, the characteristic leakage current pulse of high voltage insulators causes a voltage drop across the total resistance of the high voltage resistor of at least 5%, and preferably 10–30% of the entire line-to-ground voltage, and its shape resembles the original insulator with sheds. This high voltage resistor must be resistant to flashover and breakdown for this voltage and must be designed so that a conducting layer present on its surface and electrically connected in parallel will alter its total resistance only slightly. In accordance with the invention, this is attained by external contours with relatively high specific leakage paths. If an even shorter overall length of the outdoor insulating arrangement is desired, this is accomplished by making the external surface out of a hydrophobic material such as, for example, polytetrafluoroethylene (PTFE), ethylene-propylene monomer (EPM), ethylene-propylenediene monomer (EPDM) or silicone rubber. The hydrophobic nature of the aforementioned synthetic materials ensures the value of the surface resistance is significantly higher, even in the case of a surface layer, than the value of the resistance. In addition, the high voltage insulator resembles in its external form and configuration the original insulator with sheds. The sequence of the arrangement of such a high voltage resistor in the outdoor insulating arrangement is immaterial; it may be connected both at the earthed end and at the high voltage end, between two insulators or distributed at several locations. The effectiveness of this arrangement is based on the surprising discovery that the resulting voltage drop prevents flashover even when the characteristic leakage current pulse is exceeded.

Specifically, the insulator body may consist of a ceramic, glass or a synthetic resinous material, and the resistance material may be applied to it in the form of helices or layers of conducting or semiconducting material.

A special embodiment of the inventive concept consists in providing a hollow insulator body. Further characteristics of the preferred embodiments of the invention will become apparent from the description which follows hereinafter.

One advantage of the configuration according to the invention consists of the short overall length of the entire insulating arrangement, whereby both an economical and, as the result of the low height of the towers for an overhead line, an environmentally satisfactory embodiment is obtained. Furthermore, it is of particular advantage within the scope of the invention that existing insulating arrangements, upon which the thickness of surface layers increase in course of time, may be protected against flashover and/or the need for constant cleaning, by the insertion in series of the high voltage resistor in accordance with the invention.

The invention will now be explained in more detail with the aid of the drawings which illustrate several preferred embodiments.

Figure 1:
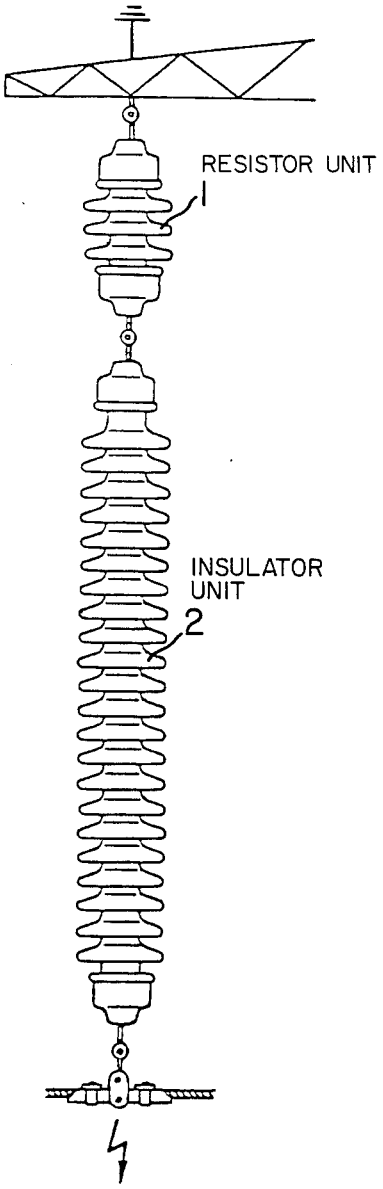
FIG. 1 is a plan view of a high voltage resistor according to the invention, arranged at the earthed end, with a long rod insulator.
Figure 2:
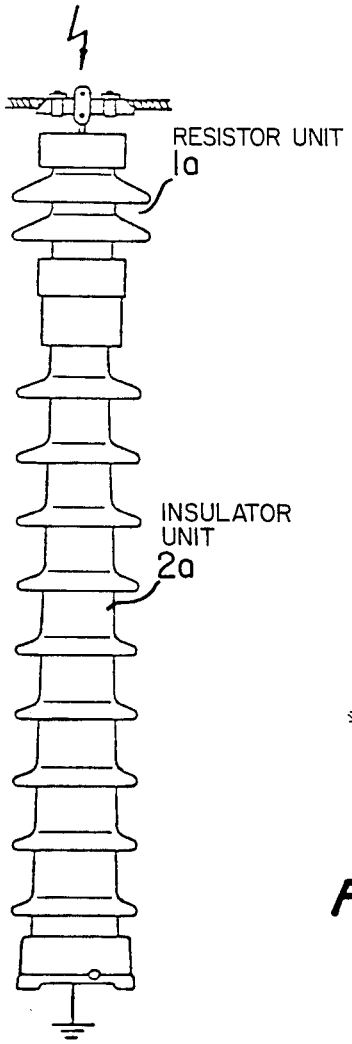
FIG. 2 is a plan view of a high voltage resistor according to the invention arranged at the high voltage end with a post insulator.
Figure 3:
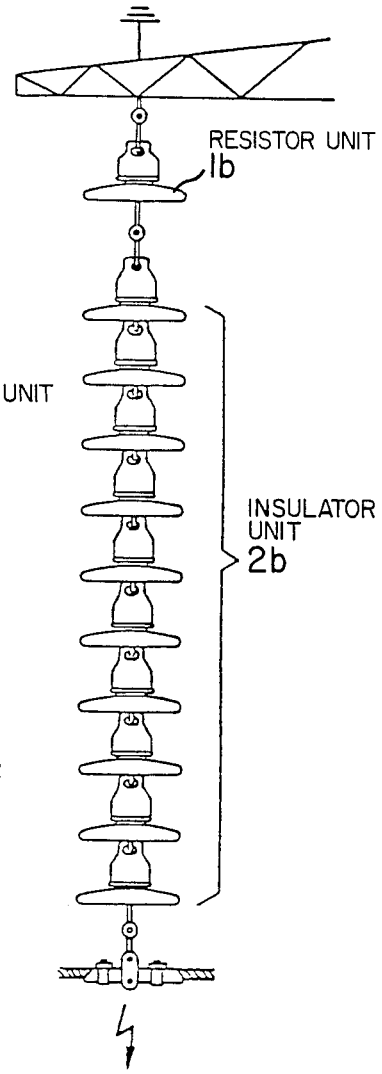
FIG. 3 is a plan view of a resistor according to the invention arranged at the earthed end, with a chain of cap-and-pin type insulators.

The high voltage resistor assembly 1, 1*a*, 1*b* according to the present invention is illustrated in series with the actual outdoor insulator 2, 2*a*, 2*b* in FIGS. 1 to 3, wherein the outdoor insulator is shown in FIG. 1 as a long rod insulator 2, in FIG. 2 as a post insulator 2*a* and in FIG. 3 as a chain of cap-and-pin type insulators 2*b*.

Figure 4:
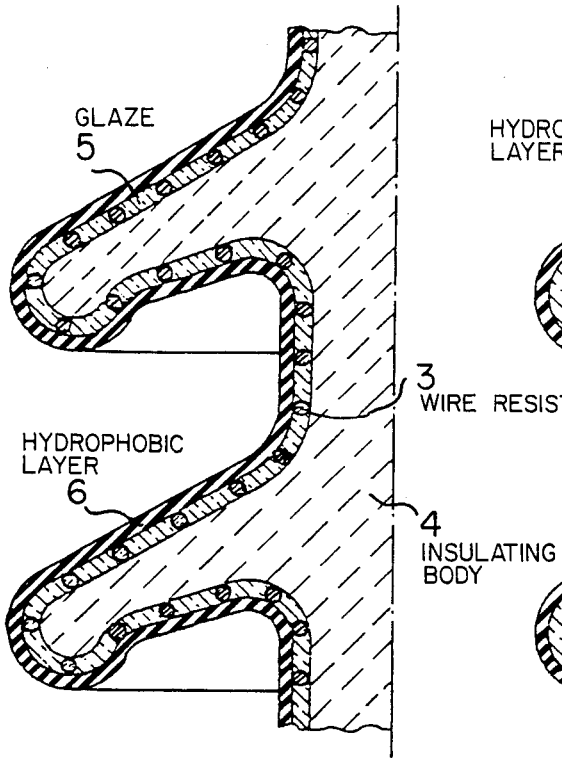
FIG. 4 is a cross-section taken through a portion of the high voltage resistor, in the configuration of a wire resistor.

In FIG. 4, a resistor for use with a long rod insulator 2 is shown. It consists of a wire resistor 3, applied helically to the surface of an insulating body 4, for example, a porcelain insulator, and embedded in a glaze 5. The surface of silicone rubber.

Figure 5:
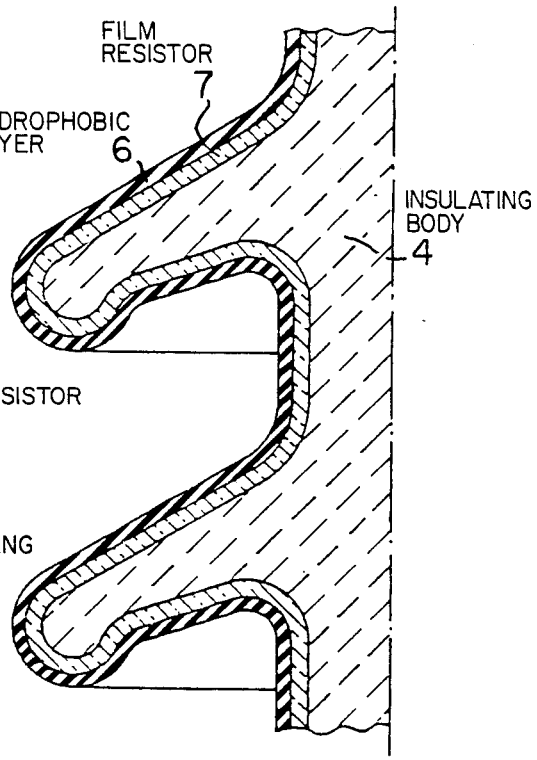
FIG. 5 is a cross section taken through a portion of the high voltage resistor, by means of conductive layer of glaze.

Another embodiment is shown in FIG. 5. A conductive glaze 7 is applied to the surface of the insulating body 4, which is again covered by a hydrophobic layer 6.

Wire or film resistors of this type may obviously be used not only for long rod insulators, but also for post insulators, a chain of cap-and-pin type insulators or for bushings, since there is no problem technically to adapt these resistors to the shed shape of these insulators.

A variation concerning the material and also the configuration of a resistor of this type insulating body 4*a* of a cylindrical shape is used. One or more resistor wires 3 are embedded in a glaze on the cylindrical surface, similarly to the conventional glazed wire resistors; insulator sheds 8 of a weather resistant synthetic resinous material, such as, for example, silicone rubber, are mounted on said body.

Figure 9:
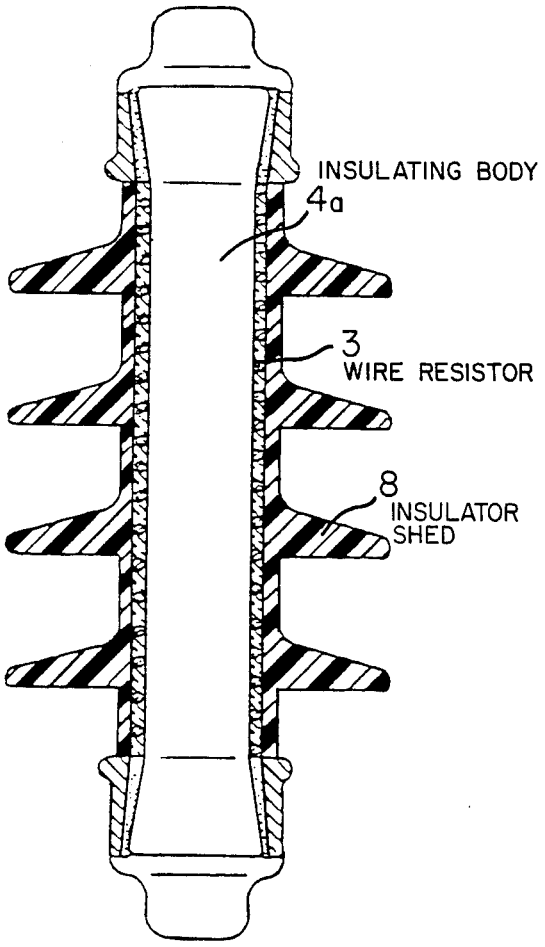
FIG. 9 is a cross section taken through a high voltage resistor of a ceramic material, in a wire resistor configuration and provided with sheds of a synthetic resinous material.
Figure 10:
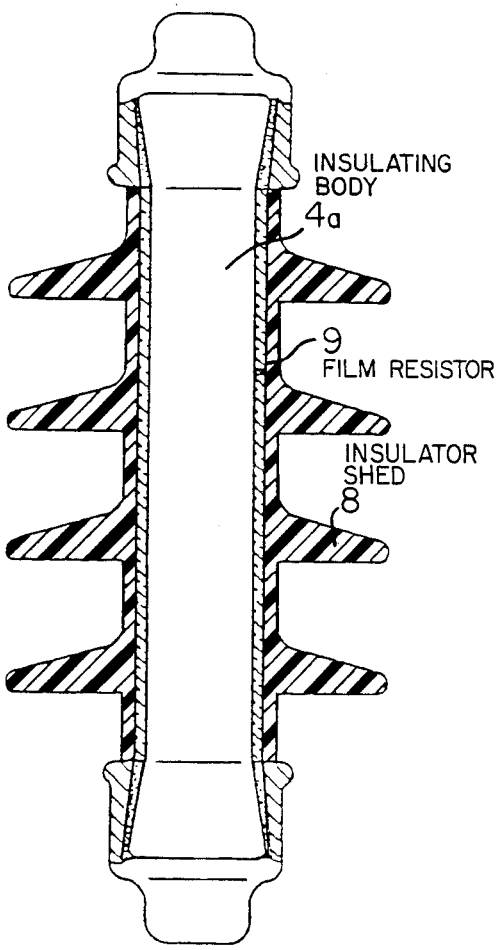
FIG. 10 is a cross section taken through the ceramic high voltage resistor, in the form of a film resistor, provided with sheds of a synthetic resinous material.

The embodiment according to FIG. 10 differs from that of FIG. 9 only in that, in place of a wire resistor, a film resistor 9 is used, formed either by a conductive glaze or by a thin deposit of a metal, with the resistor being either continuous or helical.

Figure 6:
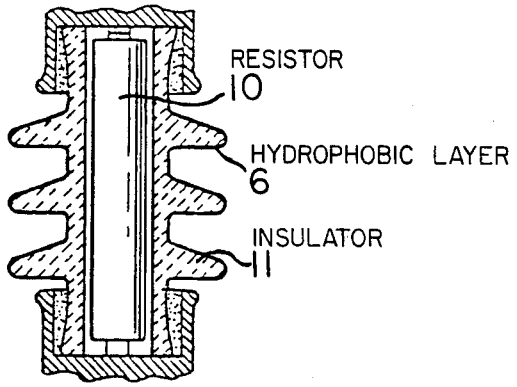
FIG. 6 is a cross section taken through a hollow insulator containing the high voltage resistor inside.

A further embodiment of the resistor is illustrated in FIG. 6. Here, a cylindrical resistor 10 is found inside a hollow insulator 11. The surface of the hollow insulator may again be coated with a hydrophobic material 6.

Figure 8:
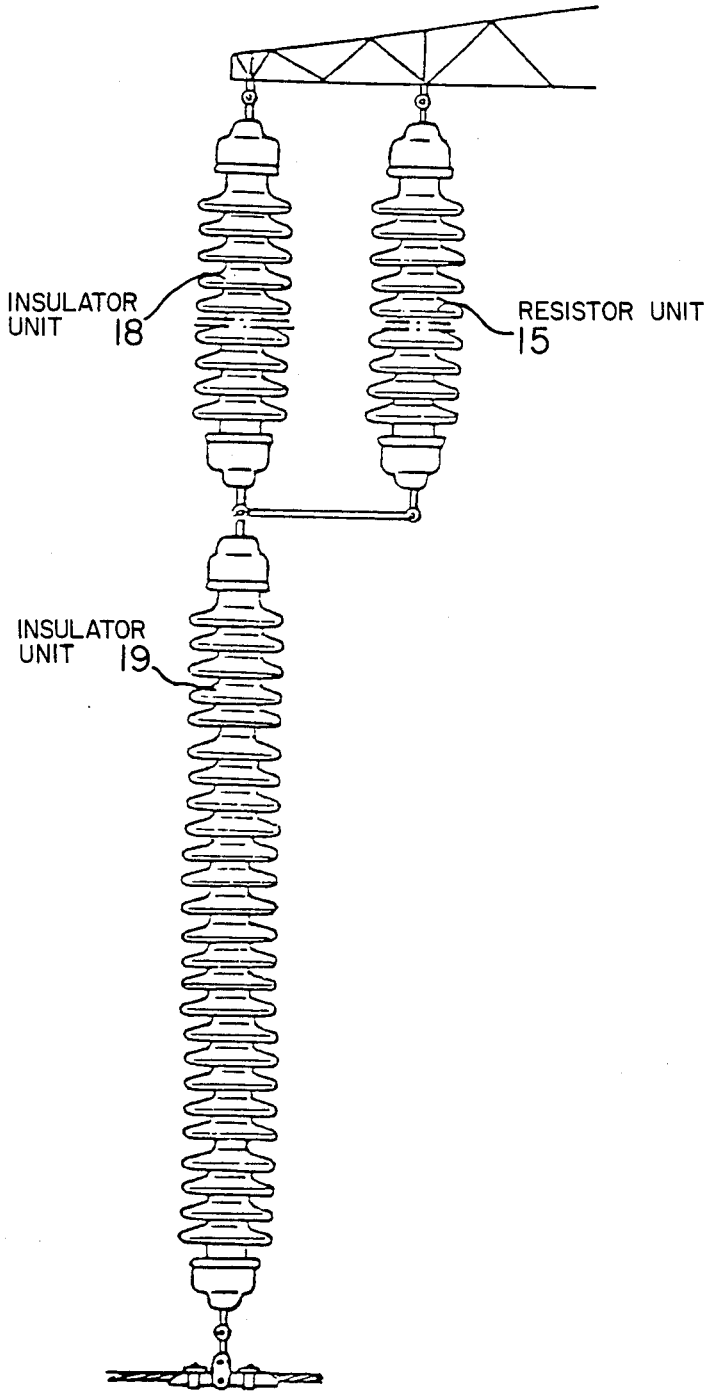
FIG. 8 is a plan view of the high voltage resistor according to the invention in a mechanically less stressed configuration, at the earthed end with a long rod insulator.

High voltage resistors according to the embodiment of FIG. 6 may be used for outdoor insulating arrangements with long rods according to FIG. 1 or post insulators according to FIG. 2, whereby the insulator bodies 11 must have adequate mechanical strength. Resistors according to FIG. 6, however, can also be used advantageously in outdoor insulating arrangements, without fulfilling high mechanical strength requirements. In FIG. 8, such an arrangement of the high voltage resistor 15 for a long rod insulator 19 is shown. The insulator 18 serves only to absorb the mechanical forces of the insulator 19 itself; electrically, it is overbridged by the resistor 15, connected in parallel.

The effectiveness of the cylindrical resistor 10 according to FIG. 6 must not be appreciably reduced by the additional parallel connection of the polluted and conductive surface of the uppermost long rod insulator 18 with the polluted and conductive surface of the resistor 15. With a suitable shape of the sheds and the surfaces of the long rod insulator 18 of the resistor 15, and with the dimensioning according to the invention of the cylindrical resistor 10, this condition is satisfied in most cases. As a typical example of the arrangement according to FIG. 8 for use in a 123 kV overhead line, a resistance value of the cylindrical resistor 10 of 20 kOhm may be cited, and a resistance value for the conductive surface of the uppermost long rod 18 due to heavy pollution and of the resistor 15 of approximately 100 kOhm each may be cited.

Figure 7:
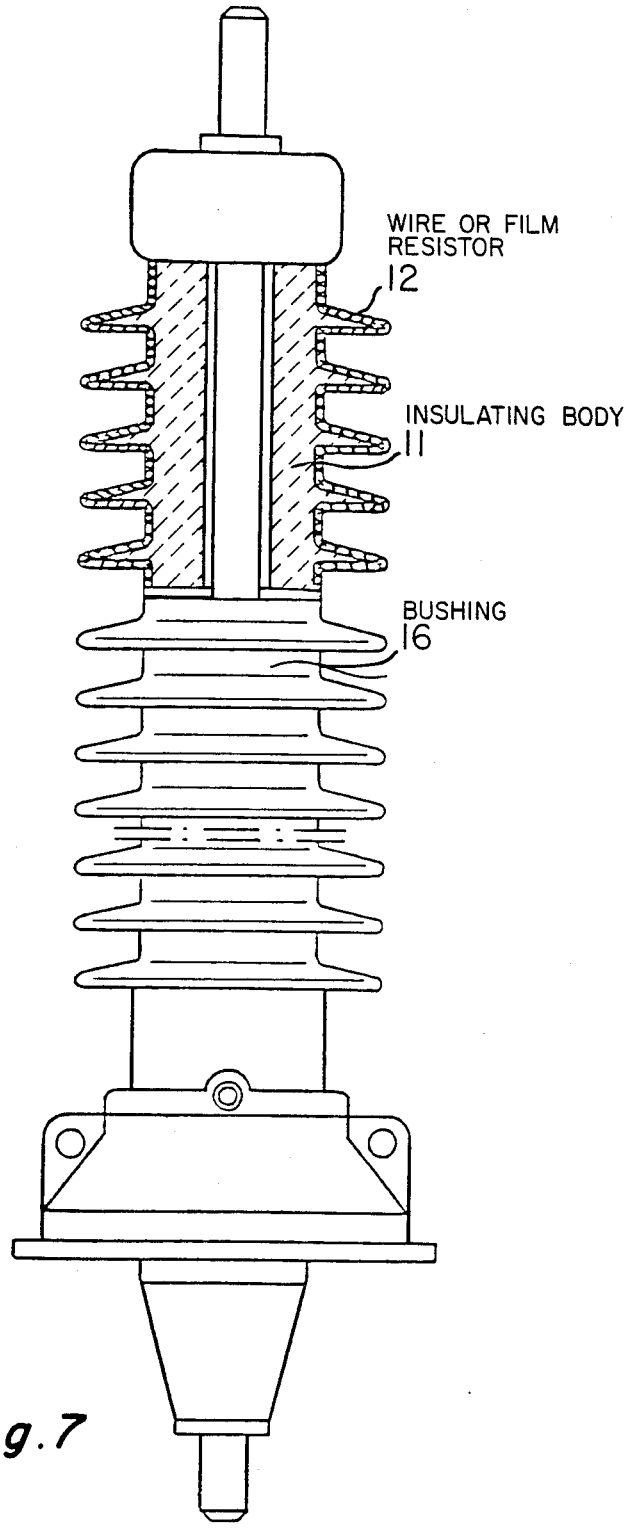
FIG. 7 is a partial cross section taken through a high voltage resistor arranged at the high voltage end of a bushing.

In the embodiment of the high voltage resistor according to FIG. 7, which is designed for use with a bushing 16, the insulating body 11 is again a hollow insulator. The resistor 12 has the configuration of one of the embodiments of FIG. 4 or FIG. 5.

Figure 11:
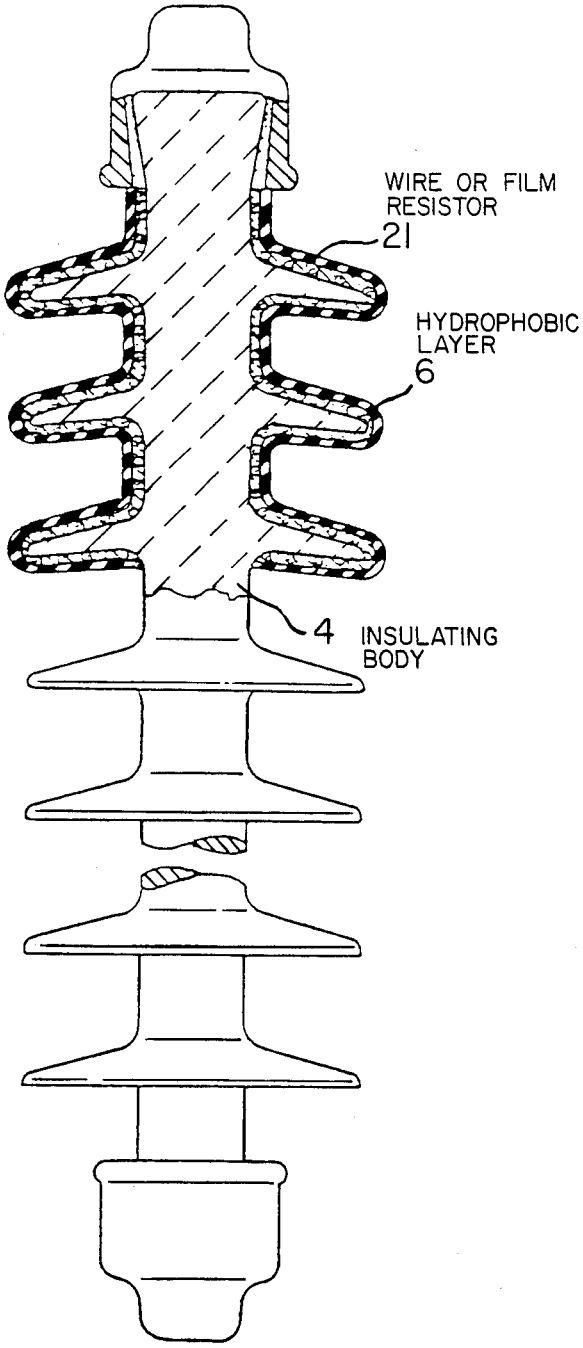
FIG. 11 is a partial cross section taken through an overhead line insulator with an integrated high voltage resistor.

A further embodiment consists of integrating the high voltage resistance into the insulator of the outdoor insulating arrangement as shown in FIG. 11. The design of the resistor can have the form according to FIG. 4, as shown in FIG. 11, or according to FIG. 5. Numeral 21 designates a wire or film resistor.

Figure 12:
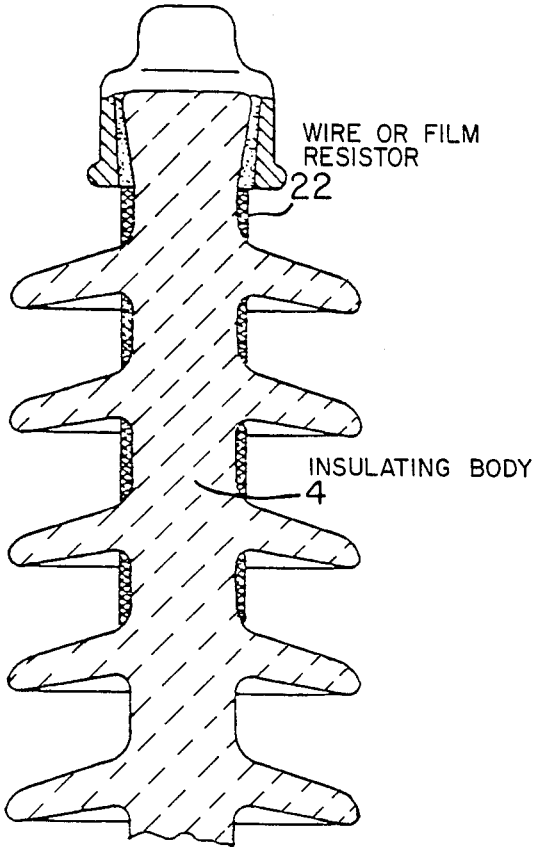
FIG. 12 is a cross section taken through an overhead line insulator or post insulator, with the high voltage resistor arranged in an integrated and distributed manner.

In the embodiment according to FIG. 12, the resistor is again integrated with the insulator of the outdoor assembly, but, in contrast to FIG. 11, it is distributed. The configuration of the partial resistors 22, arranged in the distributed form, can again be according to FIG. 4 or FIG. 5, as shown in FIG. 11.

Figure 13:
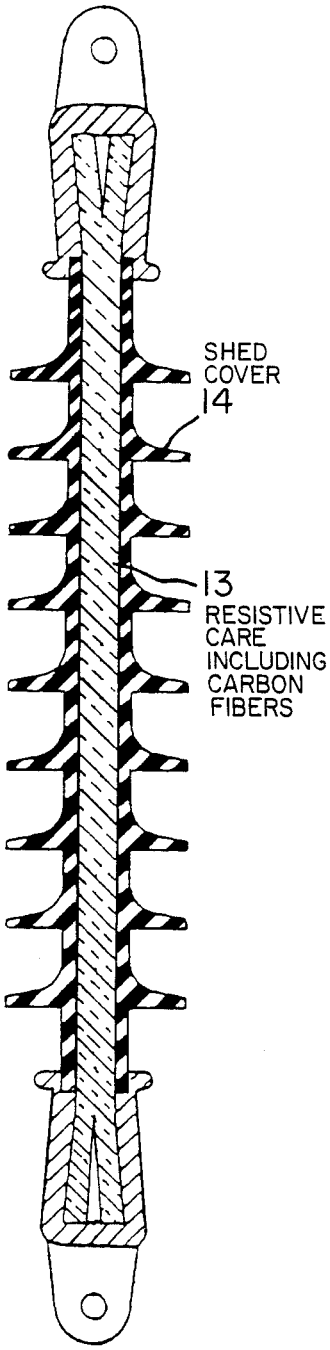
FIG. 13 is a cross section taken through a high voltage resistor with the configuration of a composite insulator, wherein the core is provided with conducting fibers.

In the embodiment according to FIG. 13, the resistor is constructed on the principle of a composite insulator, wherein a fiber-reinforced core 13 with conducting fibers, for example, carbon fibers, is used. A shed-cover 14, for example, of silicone rubber, is applied over it.

The effectiveness of the high voltage resistor according to the invention in the aforementioned arrangement will now be illustrated in more detail with the aid of an example. A ceramic long rod L 75/22 with an overall length of 1270 mm and a leakage path of 2440 mm, was used as the insulator, in accordance with the specification of DIN 48006/2. In the laboratory testing of the insulating capacity under pollution according to DIN/VDE 57448, Part 2/9.77, for the conventional arrangement, i.e., without series connection with the resistor according to the invention, a withstand salinity of 28 kg/m$^3$ was obtained at 63 kV.

A critical leakage current pulse of 1072 mA (peak value) was measured during flashover. This leakage current pulse is characteristic for the insulator used. Tests were performed with an adjustable, constant voltage source (short circuit current 20A).

In the arrangement tested for comparison, additionally a resistor according to FIG. 6 of the invention with an overall length of 160 mm, was used. It had a resistance value of 13 kOhm and was connected in series with the insulator L75/22. With an identical test voltage of 63 kV, it could not flashover even at the maximum physically possible salt content (224 kg/m$^3$). In this test without flashover, a maximum leakage current pulse of 2110 mA was measured.

At a leakage current pulse of 1072 mA (peak value), which is decisive for the dimensioning of the resistance value according to the invention, a voltage drop of 13.9 kV (peak value) occurs at the high voltage resistor. In relation to the test voltage of $63\times\sqrt{2}$ kV (peak value), this voltage drop corresponds to 15.6% of the total line-to-ground voltage.

Similar tests were performed on a chain of 8 glass cap-and-pin insulators of Type F8. With a leakage path distance of 2350 mm, the test voltage was 60.6 kV, signifying the same voltage stress per cm of the leakage path distance as in the case of the long rod insulator. For the conventional insulation, with a rigid voltage source, a withstand salinity of 40 kg/m$^3$ was determined.

The arrangement tested for comparison consisted of the insulator chain, which was connected in series with a high voltage resistor, according to the invention, of 13 kOhm. With the same test voltage of 60.6 kV, the chain of cap-and-pin insulators could not flashover at a salt content of 224 kg/m$^3$. In tests without flashover, a maximum leakage current pulse of 5515 mA was measured.

With an identical critical leakage current pulse of 1072 mA (peak value), which is decisive for the dimensioning of the resistor value, a voltage drop of 13.9 kV (peak value) occurs on the high voltage resistor of 13 kOhm. With respect to the test voltage of $60.6\times\sqrt{2}$ kV (peak value), this corresponds to 16.2% of the total line-to-ground voltage.

What is claimed is:

1. An insulator assemblage which defines a path between ground and a high voltage electrical line, comprising (a) at least one first body having a plurality of sheds, comprising an insulator material and having a characteristic critical leakage current pulse i; and (b) at least one second body comprised of a resistance material, said second body being conductively connected in series with said first body, the product of the resistance r of said resistance body and i being approximately 5% to 30% of the total line-to-ground voltage across said assemblage.

2. An insulator assemblage according to claim 1, wherein said first body comprises one selected from the group consisting of a long rod insulator, a post insulator, and a cap-and-pin-type insulator.

3. An insulator assemblage according to claim 1, further comprising a first layer comprised of a hydrophobic material, said first layer being provided on the external surface of at least said second body.

4. An insulator assemblage according to claim 3, wherein said second body comprises (a) a wire resistor wound around a core element comprised of an insulator material, and (b) said first layer provided on said external surface.

5. An insulator assemblage according to claim 3, wherein said second body comprises (a) a core element comprised of an insulator material, (b) at least one electrically conductive second layer provided on at least a portion of the surface of said core element, and (c) said first layer of said hydrophobic material external to said second layer.

6. An insulator assemblage according to claim 5, wherein said core element defines a cylinder and said second body further comprises a plurality of sheds mounted along said cylinder.

7. An insulator assemblage according to claim 5, wherein said second layer is comprised of one material selected from the group consisting of a conductive glaze and a thin deposit of a metal.

8. An insulator assemblage according to claim 5, wherein said second layer is not continuous over said surface of said core element.

9. An insulator assemblage according to claim 8, wherein said second layer defines a helical strip provided on said surface of said core element.

10. An insulator assemblage according to claim 3, wherein said first layer is comprised of one material selected from the group consisting of polytetrafluoroethylene, an ethylene-propylene monomer, an ethylene-propylenediene monomer, and silicone rubber.

11. An insulator assemblage according to claim 1, wherein said second body comprises (a) a hollow cylinder comprised of an insulator material; and (b) a core element comprised of a resistance material, said core element being disposed inside said hollow cylinder.

12. An insulator assemblage according to claim 1, wherein said second body comprises a synthetic resin insulator which contains a plurality of electrically conductive fibers.

13. An insulator assemblage according to claim 12, wherein said electrically conductive fibers comprise carbon fibers.

14. An insulator assemblage according to claim 1, wherein said second body has a plurality of sheds.

15. An insulator assemblage according to claim 1, wherein said first body is comprised of one material selected from the group consisting of ceramic, glass, and a synthetic resinous material.

16. A method for preventing flashover in an insulator exposed to atmospheric pollution, comprising the steps of:

(a) determining a characteristic critical leakage current pulse i for said insulator; and (b) conductively connecting a resistance body having a predetermined resistance value r in series with said insulator, whereby an insulator assemblage is formed, the product of r and i being between approximately 5% to 30% of the total line-to-ground voltage across said insulator assemblage.

* * * * *